US005412731A

United States Patent [19]

Desper

[11] Patent Number: 5,412,731

[45] Date of Patent: May 2, 1995

[54] AUTOMATIC STEREOPHONIC MANIPULATION SYSTEM AND APPARATUS FOR IMAGE ENHANCEMENT

[75] Inventor: Stephen W. Desper, Tujunga, Calif.

[73] Assignee: Desper Products, Inc., Los Angeles, Calif.

[21] Appl. No.: 463,891

[22] Filed: Jan. 9, 1990

Related U.S. Application Data

[63] Continuation of Ser. No. 352,638, May 12, 1989, abandoned, which is a continuation of Ser. No. 142,258, Jan. 7, 1988, abandoned, which is a continuation of Ser. No. 946,677, Jan. 5, 1987, abandoned, which is a continuation of Ser. No. 439,741, Nov. 8, 1982, abandoned.

[51] Int. Cl.[6] ..... H04S 1/00

[52] U.S. Cl. ..... 381/1; 381/63

[58] Field of Search ..... 381/28, 1, 17, 27, 63

[56] References Cited

U.S. PATENT DOCUMENTS

| | | | |
|---|---|---|---|
| 3,249,696 | 5/1966 | Van Sickle . | |
| 3,697,692 | 10/1972 | Hafler . | |
| 3,787,629 | 1/1974 | Limberg | 381/11 |
| 3,849,600 | 11/1974 | Oshima . | |
| 3,885,101 | 5/1975 | Ito et al. | 381/18 |
| 3,892,624 | 7/1975 | Shimada . | |
| 3,944,748 | 3/1976 | Kuhn | 381/1 |
| 3,985,964 | 10/1976 | Ohkubo et al. | 381/7 |
| 4,024,344 | 5/1977 | Dolby et al. | 381/27 |
| 4,072,914 | 2/1978 | Haromoto et al. . | |
| 4,087,629 | 5/1978 | Atoji et al. . | |
| 4,157,455 | 6/1979 | Okatani et al. | 381/11 |
| 4,159,397 | 6/1979 | Iwahara et al. | 381/19 |
| 4,186,273 | 1/1980 | Dodson | 381/28 |
| 4,192,969 | 3/1980 | Iwahara | 381/1 |
| 4,239,937 | 12/1980 | Kampman . | |
| 4,283,600 | 8/1981 | Cohen . | |
| 4,308,423 | 12/1981 | Cohen . | |
| 4,309,570 | 1/1982 | Carver | 369/86 |
| 4,355,203 | 10/1982 | Cohen . | |

FOREIGN PATENT DOCUMENTS 55-35582 3/1980 Japan .

OTHER PUBLICATIONS

Audio Engineering Society Preprint No. 1361, "On the Advanced Stereophonic Reproducing System" Ambience Stereo, by Sakamoto et al., May 2, 1978.

*Primary Examiner*—Forester W. Isen
*Attorney, Agent, or Firm*—Ladas & Parry

[57] ABSTRACT

The manipulation system and apparatus receives electronic signals which are to be processed and recorded for playback as enhanced stereophonic audio signals from two laterally spaced loudspeakers in front of the listener. The system and apparatus processes those signals to produce a conditioning signal, such as which would be produced by virtual room boundaries, which is heard together with the original signals so that an enlarged listening area is perceived by the listener. By amplitude and phase control of the signal to the two real speakers, the system and apparatus provide a means for control over the enhanced sound field. This enhanced sound field is perceived by the listener as being contained within boundaries larger than those normally reproduced by stereophonic speakers.

The system and apparatus generates a conditioning signal for the enhancement of natural, and generation of artificial, spatial qualities present in stereo signals usually masked in the acoustic environment in which reproduction takes place, through generation of phantom boundaries. The apparatus monitors its own output and shuts down if the output contains qualities that cannot be cut onto a record. The apparatus provides self-adjustment in the electronic system to maintain spatial masking reversal at a constant value regardless of program material.

40 Claims, 3 Drawing Sheets

BALANCED OUT
L+CL
R-CR
SATURATION DETECTION CIRCUIT
CONTROL CIRCUIT
NON INVERTING EQ.
INVERTING EQ.
ADD
HIGH PASS FILTER
SUBTRACTING
DELAY
VCA
DIMENSIONAL CONTROL
SPATIALIZATION AVAILABLE
TIME ELAPSE METER
SATURATION
MONO COMP.
DIMENSION
CLIPPING
NORM.
PWR
OFF
RESET
ACTIVE
BYPASS
STEREO INPUT 182
STEREO AUX. 384
OUTPUT

AUTOMATIC STEREOPHONIC MANIPULATION SYSTEM AND APPARATUS FOR IMAGE ENHANCEMENT

This is a continuation application of Ser. No. 07/352,638 filed May 12, 1989, now abandoned, which is a continuation application of Ser. No. 07/142,258 filed Jan. 7, 1988, now abandoned, which is a continuation application of Ser. No. 946,677 filed Jan. 5, 1987, now abandoned, which is a continuation application of Ser. No. 439,741 filed Nov. 8, 1982, now abandoned.

BACKGROUND OF THE INVENTION

This invention is directed to an automatic stereophonic image enhancement system and apparatus where the electronic signal which corresponds to the audio signal is electronically treated by amplitude and phase control to produce enhanced perception of the stereophonically reproduced music.

Sound is vibration in an elastic medium, and acoustic energy is the additional energy in the medium produced by the sound. Sound in the medium is propagated by compression and rarefaction of the energy in the medium. The medium oscillates, but the sound travels. A single cycle is a complete single excursion of the medium, and the frequency is the number of cycles per unit time. Wavelength is the distance between wave peaks, and the amplitude of motion (related to energy) is the oscillatory displacement. In fluids, the unobstructed wavefront spherically expands.

Hearing is the principal response of the subject to sound. The ear, its mechanism and nerves receive and transmit the hearing impulse to the brain which receives it, compares it to memory, analyzes it, and translates the impulse into a concept which evokes a mental response. The final step in the process of hearing takes place in the brain; the ear is only a receiver. Thus, sound is objective and hearing is subjective. Since the system and apparatus of this invention is for the automatic stereophonic image enhancement for human listening, the listening process is in perceptions. Described in this specification are those of human subjects. Because a subject has two ears, laterally spaced from each other, the sound at each eardrum is nearly always different. Some of the differences are due to the level, amplitude or energy, while others are due to timing or phase differences. Each ear sends a different signal to the brain, and the brain analyzes and compares both of the signals and extracts information from them, including information in determining the apparent position and size of the source, and acoustic space surrounding the listener.

The first sound heard from a source is the direct sound which comes by line-of-sight from the source. The direct sound arrives unchanged and uncluttered and lasts only as long as the source emits it. The direct sound is received at the ear with a frequency response (tonal quality) more true to the sound produced by the source because it is subject only to losses in the fluid medium (air). The important transient characteristics such as timbre, especially in the high registers, are conveyed by direct sound.

The interaural differences at each eardrum are found in time, amplitude and spectral differences. The physical spacing of the ears causes one ear to hear after the other, except for sound originating from a source on the median plane. The time delayed difference is a function of the direction from which the sound arrives, and the delay is up to about 0.8 millisecond. The 0.8 millisceond time delay is about equal to the period of 1 cycle at 1,100 hertz. Above this frequency, the acoustic wavelength of arriving sounds becomes smaller than the ear-to-ear spacing, and the interaural time difference decreases in significance so that it is useful only below about 1,400 hertz to locate the direction of sound. The difference in amplitude between the sound arriving at the two ears results principally from the diffracting and scattering effect of the head and external ear. These effects are greater above 400 hertz and become the source of information the brain interpretes to determine the direction of the source for higher frequencies. Other clues to elevation and direction of the sound derive from our practice of turning our head during the sound direction evaluation process. This changes the relative amplitude and time difference to provide further data for mental processing to evaluate direction. Both processes are frequency dependent, but it has been shown that the time difference is more useful with transient portions of sound while both are used for evaluation of the source direction of continuous signals.

In human hearing, memory plays an important role in the evaluation of sound. The brain compares the interaural temporal difference, interaural amplitude difference, interaural spectral difference, as well as the precedence effect, and temporal fusion, to be described later, with memories of the same factors. The brain is constantly comparing present perceptions with stored impressions so that those signals which are currently being received are compared with memory to provide a conception of the surrounding activity. When we hear sound, the combination of the sound as perceived and the memory together produce a mental image of a conceptual geometrical framework around us associated with the sources of sound to become thus a conceptual image space. In the conceptual image space, what is real and what seems to be real are the same. The present system and apparatus is directed toward generating a conceptual image space which seems to be real but, from an objective evaluation, is an illusion.

In a system where there are two, spaced loudspeaker sound sources in front of the observer, with the observer centered between them, the production of substantially the same sound from each speaker, in phase and of the same amplitude, will present to the observer a virtual sound image midway between the two speakers. Since the sound source is in phase, this virtual sound image will be called a "homophasic image." By changing the relative amplitude, the homophasic image can be moved to any point between the two speakers. In professional processing of sound signals, this moving action is called "panning" and is controlled by a pan pot.

An equally convincing virtual sound image can be heard if the polarity is reversed on one of the signals sent to one of the same two loudspeakers. This results in a 180 degree phase shift for the sound from that speaker reaching the ears. For simplification, the direct 0 degree phase shift from the (for example) left speaker first reaches the left ear and later reaches the right ear, and the 180 degree retarded phase-shifted signal from the right speaker first reaches the right ear and later the left ear, providing information to the ear-brain mechanism which manifests a virtual sound image to the rear of the center point of the listener's head. This virtual image is the "antiphasic" image. Since it is a virtual image created by mental processes, the position is different for different listeners. Most listeners hear the antiphasic image as external and to the rear of the skull. The antiphasic image does not manifest itself as a point source, but is diffused and forms rear of the listener's conceptual image space. By changing the phase relationship and/or amplitude of the left and right signals, virtual images can be generated along an arc or semicircle from the back of the observer's head toward the left or right speakers.

Another factor which influences the perception of sound is the "precedence effect" wherein the first sound to be heard takes command of the ear-brain mechanism, and sound arriving up to 50 milliseconds later seems to arrive as part of and from the same direction as the original sound. As outlined above, by delaying the signal sent to one speaker, as compared to the other, the apparent direction of the source can be changed. As part of the precedence effect, the apparent source direction is operative through signal delay for up to 30 milliseconds. The effect is dependent upon the transient characteristics of the signal.

An intrinsic part of the precedence effect, yet an identifiably separate phenomenon, is known as "temporal fusion" which fuses together the direct and delayed sounds. The ear-brain mechanism blends together two or more very similar sounds arriving at nearly the same time. After the first sound is heard, the brain suppresses similar sounds arriving within about the next 30 milliseconds. It is this phenomenon which keeps the direct sound and room reverberation all together as one pleasing and natural perception of live listening. Since the directional hearing mechanism works on the direct sound, the source of that sound can be localized even though it is closely followed by multiple waves coming from different directions.

The walls of the room are reflection surfaces from which the direct sound reflects to form complex reflections. The first reflection to reach the listener is known as a first order reflection; the second, as second order, etc. An acoustic image is formed which can be considered as coming from a virtual source situated on the continuation of a line linking the listener with the point of reflection. This is true of all reflection orders. If we generate signals which produce virtual images, boundaries are perceived by the listener. This is a phenomenon of conditioned memory. The position of the boundary image can be expanded by amplitude and phase changes within the signal generating the virtual images. The apparent boundary images broaden the perceived space.

Audio information affecting the capability of the ear-brain mechanism to judge location, size, range, reverberation, spatial identity, and ambiance can be extracted from the difference between the left and right source. Modification of this information through frequency shaping and linear delay is necessary to produce the perception of phantom image boundaries when this information is mixed back with the original stereo signal at the antiphasic image position.

The common practice of the recording industry, for producing a stereo signal, is to use two or more microphones near the sound source. These microphones, no matter how many are used, are always electrically polarized in-phase. When the program source is produced under these conditions (which are industry standard), the apparatus herein generates a "synthetic" conditioning signal for establishment of a third point with its own time domaine. This derivation is called synthetic because there is a separation, alteration and regrouping to form the new whole.

To further help establish a point with a separate time domaine, a third microphone may be used to define the location of the third point in relation to the stereo pair. Contrary to the normal procedure of adding the output of a third microphone to the left and right side of the stereo microphone pair, the third microphone is added to the left stereo pair and subtracted from the right stereo pair. This arrangement provides a 2-channel stereo signal which is composed of a left signal, a right signal, and a recoverable signal which had its source at a related but separate position in the space being recorded. This is called organic derivation and compares to the synthetic situation where the ratios are proportional to the left minus the right (from which it was derived) but is based on its own time reference, which is related to the spacing between the three microphones. The timing between the organic conditioning signal is contingent upon the position of the original sound source with respect to the three microphones. The information derived more closely approximates the natural model than that of the synthetically derived conditioning signal.

Control over either the organic or synthetic situations, the processing thereof, and the generation of a conditioning signal therefrom will produce an expanded listening experience.

All sources of sound recorded with two or more microphones in normal or organic situations contain the original directional cues. When acted upon by the apparatus of this invention, a portion of the original directional cues are isolated, modified, reconstituted and added, in the form of a conditioning signal, to the original forming a new whole. The new whole is in part original and in part synthetic. The control of the original-to-synthetic ratio is under the direction of the operator via two operating modes: 1-Space) In which the ratio is constant. Synthetic is directly proportional to the original and, therefore, enhancement depends upon the amount of original information present in the stereo program material. 2-AutoSpace) In which the ratio is electrically varied. Synthetic is inversely proportional to the original and, therefore, the enhancement is held at a constant average regardless of program material.

When a stereo recording is reproduced monophonically, it is said to be compatible if the overall musical balance does not change. The dimensionality of the stereo recording will disappear when reproduced monophonically but the inner instrumental balance should remain stable with L+R (left plus right sources) combining.

The compatibility problem arises because monophonic or L+R does not contain the total information present in the left and right sources. When combined as such, it contains only the information of similarity in vectorial proportion. The differential information is lost. Unfortunately, it is possible for the differential signal to contain as much identity about the musical content of a source as does the summation signal.

Since differential information will be lost in left plus right combining, directional elements should comprise most of the differential signal. Directional information will be of little use in monophonic reproduction and its loss will be of no consequence with respect to musical balance. Therefore, additional dimensional or spatial producing elements must be introduced in such a way that their removal in L+R combining will not destroy the musical balance established in the original stereophonic production.

Insertion of the conditioning signal at the antiphasic image position produces enhancement to and generation of increased spatial density in the stereo mode but is completely lost in the mono mode where the directional information will be unused. Information which can be lost in the mono mode without upsetting the inner instrument musical balance includes clues relating to size, location, range, and ambience but not original source information.

To accomplish this, directional information is obtained exclusively from the very source which is lost in the monophonic mode, namely, left signal minus right signal.

Whether in the synthetic or organic model derivation of a conditioning signal, subtracting the left signal from the right signal and reinserting it at the antiphasic position will not challenge mono/stereo compatibility, providing that the level of conditioning signal does not cause the total RMS difference energy to exceed the total RMS summation energy at the output.

SUMMARY OF THE INVENTION

In order to aid in the understanding of this invention, it can be stated in essentially summary form that it is directed to a stereophonic image enhancement system and apparatus wherein a conditioning signal is derived from and reintroduced into electronic signals which are to be reproduced through two spaced loudspeakers so that the perceived sound frame between the two loudspeakers is an open field which at least extends toward the listener from the plane between the loudspeakers and may include the perception of boundaries which originate to the side of the listener.

It is, thus, an objective of this invention to provide an automatic stereophonic image enhancement system and apparatus wherein two-channel stereophonic sound is reproduced with signals therein which generate a third image point with which boundary image planes can be perceived within the listening experience resulting in an extended conceptual image space for the listener.

It is a further objective to provide a stereophonic image enhancement system which includes automatic apparatus for introducing the desired density of conditioning signal regardless of program content into the electronic signal which will be reproduced through the two spaced speakers.

It is another objective to provide an automatic stereophonic image enhancement system and apparatus wherein the inner instrumental musical balance remains stable when heard in monophonic or stereophonic modes of reproduction.

It is another objective to provide a monophonically compatible automatic stereophonic image enhancement system and apparatus wherein the operator can be readily trained to employ the system and apparatus to achieve desirable recordings with enhanced conceptual image space.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

DESCRIPTION OF THE PREFERRED EMBODIMENTS

Figure 1:
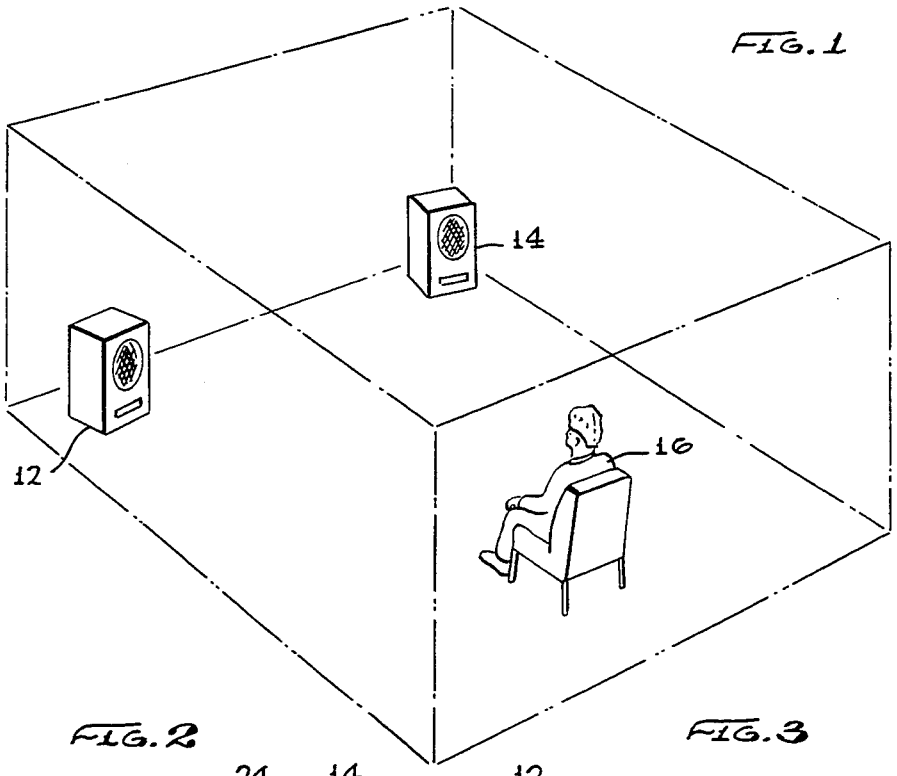
FIG. 1 is a perspective view of a listener facing two spaced loudspeakers, and showing the outline of an enclosure.

FIG. 1 illustrates the usual physical arrangement of loudspeakers for monitoring of sound. It should be understood that in the recording industry sound is "monitored" during all stages of production. It is "reproduced" when production is completed and the product is in the marketplace. At that point and on, what is being reproduced is the production. Since the invention is directed to the system and apparatus illustrated in its first preferred embodiment 10 in FIG. 5 and preferred embodiment 202 in FIG. 6 which is employed in record, motion picture, video and broadcast production to enhance the perception, it is well to understand the physical arrangements during production monitoring as well as final reproduction. During monitoring, the two loudspeakers 12 and 14 are of suitable quality with enclosures to produce the desired fidelity. They are laterally spaced, and listener 16 faces them and is positioned substantially upon a normal plane which bisects the line between the speakers 12 and 14. Usually, the listener is enclosed with the loudspeakers. During reproduction, the two loudspeakers may be of any quality. The loudspeaker and listener location is relatively unimportant. During monitoring, the effect is one of many separate parts being blended together. Hence, monitoring requires a standard listening position for evaluation consistency, whereas during reproduction, the effect has become one with the whole sound and can be perceived from any general location.

Since the apparatus is designed as a production tool, the loudspeakers 12 and 14 should be considered monitors being fed from an electronic system which includes the enhancement apparatus of this invention. The electronic system may be professional recording console, multi-track or two-track analogue, or digital recording device, with a stereophonic two-channel output designated for recording or broadcasting. The electronic system may also be two channels from a V-groove phonograph record such as in a broadcast application.

Figure 2:
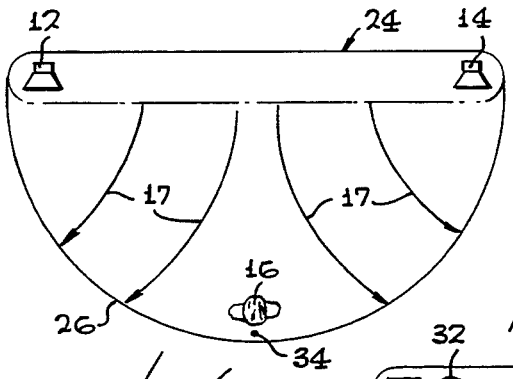
FIG. 2 is a schematic plan view of the perception of a sound frame which includes a synthetic conditioning signal which is included in the signals to the speakers.

FIG. 2 illustrates the speakers 12 and 14 as being enclosed in what is perceived as a closed field sound frame 24 (without the lower curved lines 17 and 26) which is conventional for ordinary stereophonic production. By varying the amplitude between the speakers 12 and 14, the apparent source can be located anywhere within the sound frame 24 between the speakers. When a synthetic conditioning signal is delayed before reinsertion at the antiphasic image position 34, amplitude and time ratios 17 are manifested between the loudspeakers 12 and 14, and antiphasic point 34. Because the antiphasic point 34 is the interdependent product of the left point 12 and the right point 14, the natural model is approached by synthetic construction, but never fully realized. The result is open field sound frame 26. Listener 16 perceives the open field 26.

Figure 3:
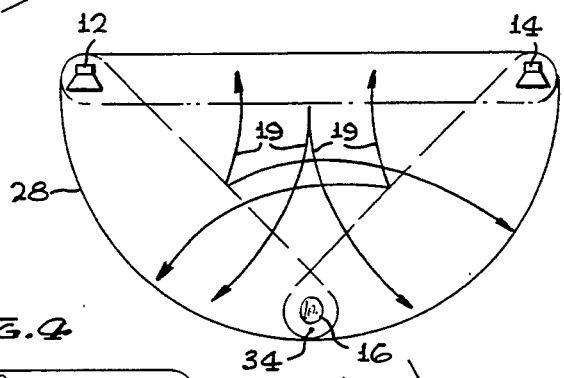
FIG. 3 is a schematic plan view of the perceived open field sound frame where an organic conditioning signal is introduced into the signal supplied to the speakers.

FIG. 3 illustrates open field sound frame 28 which is perceived by listener 16 when a conditioning signal derived, as in FIG. 2, is supplied and introduced as part of the signal to speakers 12 and 14, but has as its source an organic derivation, as described above. The density of spatial information is represented by the curved lines 17 in FIG. 2 and is represented by the curved lines 19 in FIG. 3. It is apparent that the density of spatial information is greater in FIG. 3 because the three points which produced the original conditioning signal are not electrically interdependent but are acoustically interactive; information more closely reflecting the natural model is supplied to the ear-brain mechanism of listener 16.

Figure 4:
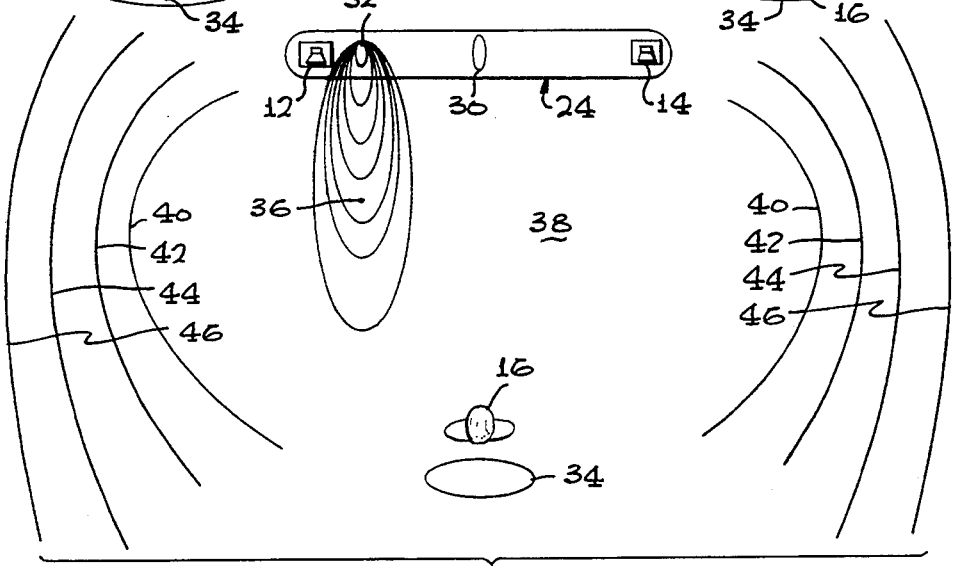
FIG. 4 is a schematic plan view of the open field sound frame, as perceived from the listener's point of view, as affected by various changes within the conditioning signal.

FIG. 4 illustrates the various factors which are sensed by the listener 16 in accordance with the stereophonic image enhancement system of this invention. The two speakers 12 and 14 produce the closed field sound frame 24 when the speakers are fed with homophasic signals. Homophasic image position 30 is illustrated, and the position can be shifted left and right in the frame 24 by control of the relative amplitude of the speakers 12 and 14. The speakers 12 and 14 produce left and right real images, and a typical hard point image 32 is located on the line between the speakers because it is on a direct line between the real images produced by the two real speakers. As described above, the hard point source image can be shifted between the left and right speakers.

The antiphasic image position 34 is produced by speakers 12 and 14 and may be perceived as a source location behind the listener's head 16 at 34 under test or laboratory demonstrations. Under normal apparatus operating conditions, source 34 is not perceived separately but, through temporal fusion, is the means by which an open field sound frame is perceived. Position 34 is a perceived source, but is not a real source. By controlling the relationship between the antiphasic image position 34 and one or both of the real images all produced by speakers 12 and 14, the image source can be located on a line between one of the real images and the antiphasic image position 34. Since the antiphasic image position 34 is a perceived source and not a real source, the point between them is considered a soft point source image. Such a soft point source image is shown at point 36. Open field sound frame 38 is thus produced and provides the perception of virtual space boundaries 40, 42, 44 or 46, depending upon the conditioning signal's phase relationship to the orignal source. The perceived distance for the virtual space boundaries 40, 42, 44 and 46 from the closest hard point is from 2 to 30 feet, depending on the dimension control setting of FIG. 5.

Now considering the system and apparatus 10 which produces these results, left input lines 48 and 49 and right input lines 50 and 51 are received from music signal sources. The system and apparatus 10 is described in its preferred embodiment as being a system which introduces the conditioning signal before the two-channel recording and, thus, is a professional audio laboratory system and apparatus. Thus, the left and right inputs 48, 49, 50, 51 are the product of a live source or a mixdown from multiple channel tape produced by the live recording. The inputs of the apparatus 48, 49, 50, 51 address the output of the recording console's "quad buss" or "4-track buss." Each position on the recording console can supply each and every buss of the quad buss with a variable or "panned" signal representing that particular position. Two channels of the quad buss are meant for use as stereo or the front half of quadraphonic sound; the other two channels, for the rear half of quadraphonic sound. Normally, each position or input of a modern recording console has a panning control to place the sound of that input between left, right, front, or back via the quad buss. A recording console may have any number of inputs or positions which are combined into the quad buss as four separate outputs. The left front quad buss channel addresses apparatus input 48; the right front quad buss channel addresses apparatus input 50; the left rear quad buss channel addresses apparatus input 49; and the right rear quad buss channel addresses apparatus input 51. Alternate insertion of the apparatus is possible in the absence of a quad buss by using the stereo buss plus 2 effect busses. Left front input 49 (unprocessed) is connected to amplifier 52. Left rear input 48 (processed) is connected to amplifier 54. Right rear input 50 (processed) is connected to amplifier 56. Right front input 51 (unprocessed) is connected to amplfiier 58. The outputs of amplifiers 52 and 58 are respectively connected to the last adders 60 and 62, respectively, so that amplifiers 52 and 58 effectively bypass the enhancement system. The use of the quad buss allows the apparatus to address its function to each input of a live session or each track of recorded multitrack information, separately. This means that, in production, the operator/engineer can determine the space density of each track rather than settling for an overall space density. This additional degree of creative latitude is unique to this apparatus and sets it apart as a production tool.

The amplified left and right signals in lines 68 and 70 are both connected to summing amplifier 72 and differencing amplifier 74. The output in line 76 is, thus, L+R, but the amplifier 72 also serves to invert the output so that it appears as −(L+R). Differencing amplifier 74 is also inverting so that the signal in line 78 is −(L−R). These sum and difference signals in lines 76 and 78 are added together in adder 60 and regenerate the original left program. The signal in line 78 also goes through inverter 80 to produce in line 82 the (L−R) signal. Lines 76 and 82 are introduced into adder 62 to regenerate in its output line 84 the original right program. The output lines 79 and 84 from the last adders 60 and 62 go to the balanced-output output amplifiers 86 and 88 for the left output and 90 and 92 for the right output. The output amplifiers are differential amplifiers operating as a left pair and a right pair, with one of each pair operating 180 degrees out of phase with the other half of each pair for balanced line output.

The conditioning signal is derived from the difference signal −(L−R) in line 78 at the output of differencing amplifier 74. The difference signal in line 78 passes through high pass filter 94 which has a slope of about 18 decibels per octave and a cutoff frequency of about 300 hertz to prevent comb filtering effect at lower frequencies. The filtered signal passes through digital delay 96 with adjustable and selectable delay settings as a manual input from manual control knob 98, see FIGS. 5 and 7. This is called "the dimension control." The output of the delay 96 goes to voltage controlled amplifier 102 which manages automatic level control. The DC control voltage in line 104 which controls voltage control amplifier 102 is supplied by potentiometer 106 controlled on the front panel in the manual mode and by the hereinafter described control circuit in the automatic mode.

The output from voltage controlled amplifier 102 in line 108 is connected to left equalizer 110 and right equalizer 112 for a proper equalization and phasing for the individual left and right channels. The illustrated equalizers 110 and 112 are of the resonant type (although they could be any type) with a mid-band boost of 2 db at a left channel center frequency in equalizer 110 of about 1.5 kilohertz and a right channel frequency in equalizer 112 of about 3 kilohertz. After passing through the equalization circuits, there is a left conditioning signal in line 114 and a right conditioning signal in line 116. The left conditioning signal is added in adder 60. The right conditioning signal in line 116 is connected to inverter 80 where the conditioning signal is added to the difference signal $-(L-R)$ and the sum is added to the sum signal to result in the right signal plus conditioning signal on line 84.

The control circuit generally indicated at 118 monitors the output signal in lines 79 and 84 and regulates the amount of conditioning signal to keep the Lissajous figure of the output relatively constant. The Lissajous figure is a figure displayed on the CRT of an oscilloscope when the two outputs are connected to the sweep and amplitude drives of the oscilloscope. When the Lissajous figure is fairly round, the energy ratio between the sum and difference of the two outputs is substantially 1 (a desirable characteristic). Lines 84 and 79 are respectively connected to the inputs of differencing amplifier 120 and adding amplifier 122. The outputs are respectively rectified, and rectifiers 124 and 126 provide signals in lines 128 and 130. The signals in lines 128 and 130 are, thus, the full wave rectified sum and difference signals of the apparatus output respectively out of subtracter 120 and adder 122.

Figure 5:
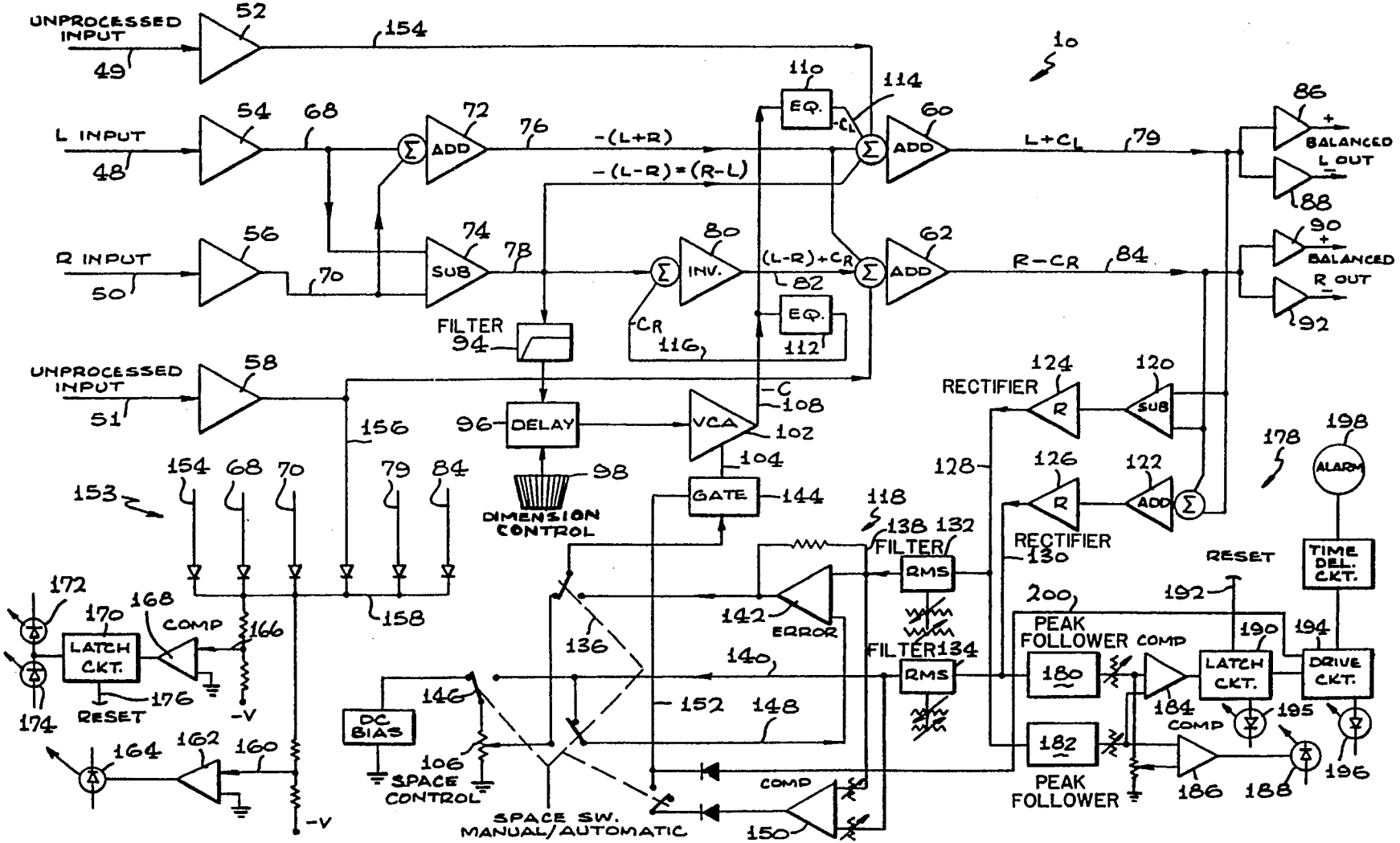
FIG. 5 is a schematic electrical diagram of the automatic stereophonic image enhancement system and apparatus in accordance with this invention.

Lines 128 and 130 are connected to filters 132 and 134 which have adjustable rise and fall ballistics. Selector switch 136 selects between the manual and automatic control of the control voltage in line 104 to voltage controlled amplifier 102. The manual position of selector switch 136 is shown in FIG. 5, and the use of the spatialization control potentiometer 106 has been previously described. There are several individual switches controlled by selector switch 136, as indicated in FIG. 5. When the space control switch is switched to the other, automatic position, the outputs of filters 132 and 134 in lines 138 and 140, respectively, are processed and are employed to control voltage control amplifier 102.

When space control selector switch 136 is in the automatic position, the output of error amplifier 142 is connected through gate 144 to control the voltage in line 104. The error amplifier 142 has inputs directly from line 138 and from line 140 through switch segment 146 and back through line 148. The filtered sum signal in line 140 is connected through the space potentiometer 106 so that it can be used to reduce the apparent level of the output sum information to error amplifier 142 to force the error amplifier 142 to reduce the sum/-difference ratio.

Comparator 150 is connected to receive the filtered sum and difference information in lines 138 and 140. Comparator 150 provides an output into gate line 152 when space control selector switch 136 is in the automatic mode and when a monophonic signal is present at inputs 48 and 50. This occurs, for example, when an announcer speaks between music material. When comparator 150 senses monophonic material, gate line 152 turns off gate 144 to shut down voltage controlled amplifier 102 to stop the conditioning signal. This is done to avoid excessive increase in stereo noise, from random phase and amplitude changes, while the input program material is fully balanced. The automatic control circuit 118 cannot distinguish between unwanted noise and desired program material containing difference information. Therefore, a threshold ratio is established between the sum and difference information in lines 138 and 140 by control of the input potentiometers into comparator 150. The comparator 150 and gate 144 thus avoid the addition of false space information in a conditioning signal which, in reality, would be response to difference noise in the two channels. The comparator 150 thus requires a specific threshold ratio between the sum and difference information, under which the gate 144 is turned off and over which the gate 144 is turned on.

Clipping circuit 153, see the lower left of FIG. 5, is provided to present a signal when the system is almost in a clipping situation and another signal when clipping is present. "Clipping" is a rapid increase in distortion caused by dynamic peaks in the program material being limited by the static limit imposed by the power supply voltage in the circuit. Lines 154 and 156, which are the outputs of amplifiers 52 and 58, are connected, along with lines 68, 70, 79 and 84, each through their own diode to bus 158. Bus 158 is connected through a resistance to input 160 of comparator 162. A negative constant voltage source is connected through another resistor to the input 160, and the comparator 162 is also connected to ground. By management of the two resistors, the comparator 162 has an output when bus 158 reaches a particular level. When that level is reached, output signal 164, such as a signal light, is actuated. Bus 158 is similarly connected through a resistor to the input 166 of comparator 168. The negative voltage source is connected through another resistor to input 166, and the resistance values are adjusted so that comparator 168 has an output when clipping is taking place. Latching circuit 170 is actuated when clipping has taken place to illuminate the two signal lights 172 and 174. Those lights stay illuminated until reset 176 is actuated.

In the cutting of records, a sum signal will result in lateral motion of the stylus and a difference signal will result in vertical motion. Vertical motion is the most difficult to track in playback. Therefore, large signals which produce too much vertical motion when referenced to lateral motion are usually avoided. It can be considered saturation of the cutting function. Not exceeding the saturation point is extremely important in proper disk curdling. Therefore, saturation detection circuit 178 is shown in the lower right corner of FIG. 5. The recified sum and difference signals in lines 130 and 128 are connected to peak followers 180 and 182. The peaks generated by the peak followers 180 and 182 are connected to comparators 184 and 186. Comparator 184 gives an output pulse whenever the difference peak envelope becomes greater than the sum peak envelope, within plus or minus 6 db. The level controls at the outputs of the peak followers 180 and 82 allow an adjustment in the plus or minus 6 db difference for different applications. Comparator 186 has an output when sum/difference peak ratio approaches the trigger point of comparator amplifier 184 within about 2 db, and lights signal light 188 on the front panel, illustrated in FIG. 7, as a visual warning of approaching saturation. This is accomplished by reducing the apparent level of the sum envelope by about 2 db with the potentiometer connecting comparator 186 to ground. The output of comparator amplifier 184 feeds a latching circuit 190 which activates light 195 and which holds until reset by switch 192. When the latching circuit is active, it activates driving circuit 194 which lights panel lights 196 (seen in FIG. 5) and 197 (seen in FIG. 7) and, after a time delay, rings audible alarm 198. At the same time, driving circuit 194 energizes line 200 which cuts off gate 144 to withhold the signal to amplifier 102 which controls the conditioning signal. Actuation of gate 144 removes the conditioning signal from line 108, but permits the normal stereo signal to continue through the circuit.

Figures 6, 7:
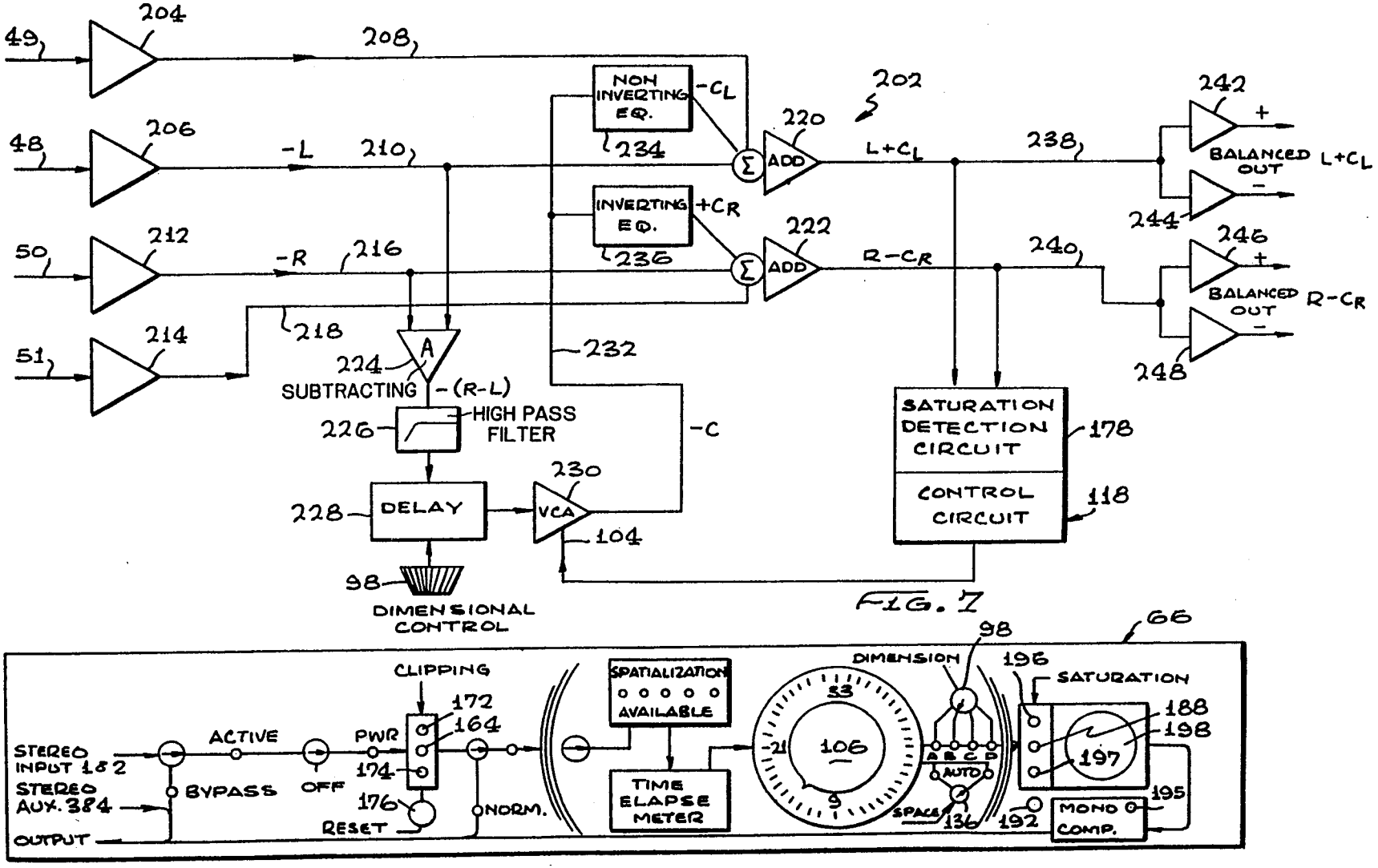
FIG. 6 is a schematic electrical diagram of an alternate circuit therefor.
FIG. 7 is a front view of the control panel for the apparatus in accordance with this invention.

Another preferred embodiment of the system and apparatus of this invention is shown in FIG. 6 and is generally indicated at 202. For application reasons already stated with respect to the system and apparatus 10 of FIG. 5, the left front quad buss channel addresses unprocessed input 49 which is connected to amplifier 204; the left rear quad buss channel addresses processed input 48 which is connected to amplifier 206; the right rear quad buss channel addresses processed input 50 which is connected to amplifier 212; and the right front quad buss channel addresses unprocessed input 51 which is connected to amplifier 214. Amplifiers 204, 206, 212 and 214 provide signals in lines 208, 210, 216 and 218, respectively. Both lines 208 and 210 are connected to summing amplifier 220, while both lines 216 and 218 are connected to summing amplifier 222.

The conditioning signal is derived by connecting differencing amplifier 224 to both lines 210 and 216. The resulting difference signal is filtered in high pass filter 226, similar to filter 94 in FIG. 5, and the result is subject to selected delay in delay circuit 228. The delay time is controlled from the front panel, as described with respect to FIG. 7. The output from delay 228 goes through voltage controlled amplifier 230 which has an output in line 232 to both non-inverting equalizer 234 and inverting equalizer 236. Those equalizers respectively have outputs connected to the summing amplifiers 220 and 222. The conditioning signal is added in the original left signal at amplifier 220 and is subtracted from the original right signal at amplifier 222. The outputs from amplifiers 220 and 222, in lines 238 and 240, respectively, are respectivley connected to balanced left amplifiers 242 and 244 and balanced right amplifiers 246 and 248, in the manner described with respect to amplifiers 86 through 92. It is useful to connect the various points in the circuit of FIG. 6 to the clipping and saturation warning circuits 152 and 178 in the same manner as previously described. The difference between the two preferred embodiments of the system in FIGS. 5 and 6 lies in the way the original left and right signals are routed. In FIG. 5, the left and right signals are added and subtracted. This sum and difference information is then re-added and re-subtracted to reconstruct the original left and right signals. In the circuit of FIG. 6, the original left and right signals are not mixed together. They remain independent of each other from input to output.

FIG. 7 shows the layout of a front control panel 66 which carries the manual inputs and displays suitable for the control of the system and apparatus of this invention. Clipping indicator lamps 164, 172 and 174 indicate a clipping condition, and the two signal lamps 172 and 174 remain illuminated until reset 176 is actuated. As previously discussed, potentiometer 106 controls voltage controlled amplifier 102. Knob 98 controls the delay, and switch 136 selects between the manual and automatic control of the voltage in line 104. Lamp 188 warns of approaching saturation, and lamps 196 and 197 indicate further levels of saturation and are latched on until reset by reset switch 192. In this way, the controls on control panel 66 provide control for the system for image enhancement.

In this way, the enhancement system is automatic with self-controlling features in the apparatus so that the stereophonic image enhancement can be achieved without continual adjustment of the system and apparatus.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. An automatic stereophonic image enhancement system comprising:

left and right lines each having an input and an output;

a left adder in said left line and a right adder in said right line respectively between said input and said output;

input connection means connected to each of said left and right lines between its respective input and its adder said input connection means receiving any signal appearing at the left line input and receiving any signal appearing at the right line input, said input connection means producing a combined signal comprised of a combination of the signals received from the left and right line inputs;

delay means connected to said input connection means for delaying the combined signal at said input connection means to produce a delayed signal;

control means for receiving said delayed signal from said delay means, said control means having an output connected to both of said adders in said left and right lines for delivery of the delayed signal thereto, said control means controlling the amplitude of the delayed signal so as to produce a delayed and amplitude controlled compensation signal to each said adder; and output connection means connected to both said left and right lines between said adders and said respective outputs, said output connection means sensing the signal in said left and right lines at said outputs thereof and being connected to said control means for automatically adjusting said control means to maintain the delayed and amplitude controlled signal in said adders substantially at a desired level.

2. The system of claim 1 wherein said control means is a voltage controlled amplifier.

3. The system of claim 1 wherein said delay means comprises a high pass filter having a slope of approximately 18 decibels per octave and a cutoff frequency of approximately 300 hertz.

4. The system of claim 3 wherein an equalizer is disposed between said controller and each adder to which it is connected 5. The system of claim 1 further including a differencing amplifier and a summing amplifier both connected to said left and right lines adjacent the output thereof to produce difference signal and a sum signal, a rectifier connected to each said differencing and summing amplifier, a comparator connected to both of said rectifiers, said comparator having an output connected to said control means so that the compensation signal from said control means is controlled by said comparator for automatic adjustment of said compensation signal as a function of the sum and difference of the signals in said left and right lines adjacent the output thereof.

6. The system of claim 5 further including a manually controllable potentiometer and a switch, said switch being connected to said comparator and to said potentiometer and, being manually operable to selectively connect said comparator and said potentiometer to said controller so that the amplitude of said delayed and amplitude controlled compensation signal can be selectively automatically and manually achieved.

7. The system of claim 6 wherein said control means is a voltage controlled amplifier.

8. The system of claim 7 wherein said delay means for producing a delayed signal is a digital delay means.

9. The system of claim 7 wherein one of said left and right lines has an input subtractor therein located between its adder and its input and the other of said left and right lines having an input adder therein between its input and its adder, both said input subtractor and said input adder in said left and right lines adjacent the respective inputs thereof being connected to both said left and right lines, said input connection means being connected to one of said input adder and said input subtractor.

10. The system of claim 9 wherein said adders in said left and right lines are connected so that a left signal at the input of said left line produces a left signal plus a compensation signal at the output of said left line and a right signal at the input of said right line produces a right signal plus a delayed and amplitude controlled compensation signal at the output of said right line, said delayed and amplitude controlled compensation signal being such that, when said left and right signals are respectively connected to left and right spaced loudspeakers, an observer positioned in front of said loudspeakers senses a virtual sound image as if said sound image were created by boundaries located to the side of said loudspeakers and a virtual sound source behind him.

11. The system of claim 9 wherein a clipping sensor is connected to said left and right lines adjacent the input and output thereof, said clipping sensor having a comparator therein comparing signal level to a preset value and said clipping sensor emitting a signal when the amplitude sensed by said clipping sensor reaches said preset value.

12. The system of claim 1, wherein said adders in said left and right lines are connected so that a left signal at the input of said left line produces a left signal plus a delayed and amplitude controlled compensation signal at the output of said left line and a right signal at the input of said right line produces a right signal plus a delayed and amplitude controlled compensation signal at the output of said right line, said delayed and amplitude controlled compensation signals being such that, when said left and right signals are respectively connected to left and right spaced loudspeakers, an observer positioned in front of said loudspeakers senses a virtual sound image as if said sound image were created by boundaries located to the side of said loudspeakers and a virtual sound source behind him.

13. The system of claim 9 wherein a saturation sensor is connected to said right and left lines, said saturation sensor being connected to compare signal peaks with a preset standard and emit a signal when signal peaks reach said preset standard.

14. The system of claim 13 wherein a clipping sensor is connected to said left and right lines adjacent the input and output thereof, said clipping sensor having a comparator therein comparing signal level to a preset value and said clipping sensor emitting a signal when the amplitude sensed by said clipping sensor reaches said preset value.

15. The system of claim 5 wherein the output of said control means is connected through a non-inverting equalizer to one of said adders and is connected through an inverting equalizer to the other of said adders.

16. The system of claim 15 wherein said delay means is an adjustable time delay so that manual adjustment can control the amount of time the signal is delayed.

17. The system of claim 15 wherein said delay means is an adjustable time delay so that manual adjustment can control the amount of time delay of the signal so that the perceived source of sound can be controlled to locate it away from virtual source perceived by a listener.

18. The system of claim 1 wherein said delay means is a frequency selective delay means and there are four input connections for connection to a quad buss, said four inputs being connected respectively to four input amplifiers, each of said input amplifiers having an output line, the output line of the first of said amplifiers being said left line and the output line of the second of said amplifiers being said right line and the output lines of the third and fourth of said amplifiers being respectively connected to said left and right adders to that the quad buss signals connected to said first and second amplifiers and in said left and right lines are subject to frequency dependent delay and addition, while the quad busses connected to the third and fourth amplifiers contribute unprocessed signals.

19. The system of claim 18 wherein said delay means comprises a high pass filter having a slope of approximately 18 decibels per octave and a cutoff frequency of approximately 300 hertz.

20. The system of claim 19 wherein an equalizer is disposed between said controller and each adder to which it is connected.

21. The system of claim 1 wherein a gate is connected in input-gating relationship to said control means, and a comparator means is connected between said output connection means and said gate, said comparator means including input potentiometers establishing a threshold ratio between left and right signal inputs to said comparator means, said comparator means sensing the presence of a monophonic signal for closing said gate for deactivating said control means during the presence of such monophonic signal.

22. The system of claim 21 wherein said delay means comprises a high pass filter having a slope of approximately 18 decibels per octave and a cutoff frequency of approximately 300 hertz.

23. The system of claim 22 wherein an equalizer is disposed between said controller and each adder to which it is connected.

24. The system of claim 5 wherein said delay means comprises a high pass filter having a slope of approximately 18 decibels per octave and a cutoff frequency of approximately 300 hertz.

25. The system of claim 24 wherein an equalizer is disposed between said controller and each adder to which it is connected.

26. The system of claim 5 wherein said control means is controlled by said comparator for automatic adjustment of said compensation signal as a function of the ratio of the sum of the signals in said left and right lines adjacent the output thereof to the difference between the signals in said left and right lines adjacent the output thereof.

27. The system of claim 12 wherein said delay means comprises a high pass filter having a slope of approximately 18 decibels per octave and a cutoff frequency of approximately 300 hertz.

28. The system of claim 27 wherein an equalizer is disposed between said controller and each adder to which it is connected.

29. The system of claim 1 wherein a stereophonic musical signal is produced at said outputs of said left and right lines, so that when said outputs of said left and right lines are combined they produce a signal suitable for monophonic reproduction with respect to musical balance.

30. An automatic stereophonic enhancement system comprising:

a left channel line having a left input and a left output, said left input being adapted to receive a left channel input signal, and said left output being adapted to deliver a left channel output signal;

a right channel line having a right input and a right output, said right input being adapted to receive a right channel input signal, and said right output being adapted to deliver a right channel output signal;

a left adder in said left channel line between said left input and said left output, said left adder being adapted to receive said left channel input signal;

a right adder in said right channel line between said right input and said right output, said right adder being adapted to receive said right channel input signal;

a delay means having delay means inputs connected to both of said left and right inputs so that said delay means may receive said left and right channel input signals, said delay means having a delay means output, said delay means creating at said delay means output a delayed signal which delayed signal is a combination of said right channel input signal and said left channel input signal and which is delayed with respect to said left and right channel input signals;

a control means having a control means input connected to said delay means output for receiving said delayed signal, said control means having a control means output connected to each of said left and right adders, said control means delivering an amplitude controlled delayed signal to each of said left and right adders whereby each of said left and right adders receives the amplitude controlled delayed signal in addition to the left channel input signal and the channel input signal right received by said left and right adders, respectively; and output sensing means having sensing means inputs connected to each of said left and right channel lines between its adder and respective output and having a sensing means output connected to said control means, said output sensing means sensing the left and right channel output signals and automatically adjusting said control means to maintain said amplitude controlled delayed signal at a desired level.

31. The system of claim 30 wherein said delay means comprises a high pass filter having a slope of approximately 18 decibels per octave and a cutoff frequency of approximately 300 hertz.

32. The system of claim 31 wherein an equalizer is disposed between said controller and each adder to which it is connected.

33. The system of claim 30 wherein said output sensing means automatically adjusts said control means as a function of the ratio of the sum of said left and right channel output signals to the difference between said left and right channel output signals.

34. An automatic stereophonic enhancement system comprising:

a first line having a first line input and a first line output, said first line input being adapted to receive a first input signal, and said first line output being adapted to deliver a first output signal;

a second line having a second line input and a second line output, said second line input being adapted to receive a second input signal, and said second line output being adapted to deliver a second output signal;

a first adder in said first line between said first line input and said first line output, said first adder being adapted to receive said first input signal;

a second adder in said second line between said second line input and said second line output, said second adder being adapted to receive said second input signal;

a differencing means having differencing means inputs connected to both of said first and second line inputs, said differencing means having a differencing means output, said differencing means creating at said differencing means output a difference signal, said difference signal being the difference between said first and second input signals;

a delay means having a delay means input connected to said differencing means output, said delay means having a delay means output, said delay means creating at said delay means output a delayed difference signal which is delayed with respect to said first and second input signals;

a control means having a control means input connected to said delay means output for receiving said delayed difference signal, said control means having a control means output connected to each of said first and second adders, said control means delivering an amplitude controlled delayed difference signal to each of said first and second adders whereby each of said first and second adders receives the amplitude controlled delayed difference signal in addition to the first and second input signals received by said first and second adders, respectively; and output sensing means having sensing means inputs connected to each of said first and second lines between its adder and respective output and having a sensing means output connected to said control means, said output sensing means sensing the first and second output signals and automatically adjusting said control means to maintain said amplitude controlled delayed signal at a desired level.

35. The system of claim 34 wherein said control means output is connected to said first and second adders such that the amplitude controlled delayed difference signal arriving at said first adder is out of phase with respect to the amplitude controlled delayed difference signal arriving at said second adder.

36. The system of claim 34 wherein an inverter is disposed between said control means output and said first adder.

37. The system of claim 34 wherein said first adder adds said amplitude controlled delayed difference signal to said first input signal and said second adder subtracts said amplitude controlled delayed difference signal from said second input signal.

38. The system of claim 34 wherein said delay means comprises a high pass filter having a slope of approximately 18 decibels per octave and a cutoff frequency of approximately 300 hertz.

39. The system of claim 38 wherein an equalizer is disposed between said controller and each adder to which it is connected.

40. The system of claim 34 wherein said output sensing means automatically adjusts said control means as a function of the ratio of the sum of said left and right channel output signals to the difference between said left and right channel output signals.

* * * * *